US008901818B2

(12) United States Patent
Ryu et al.

(10) Patent No.: US 8,901,818 B2
(45) Date of Patent: Dec. 2, 2014

(54) SPARK GAP SWITCH FOR HIGH POWER ULTRA-WIDEBAND ELECTROMAGNETIC WAVE RADIATION FOR STABILIZED DISCHARGE

(71) Applicant: Agency for Defense Development, Daejeon (KR)

(72) Inventors: Jiheon Ryu, Daejeon (KR); Cheon Ho Kim, Daejeon (KR); Jaimin Lee, Daejeon (KR)

(73) Assignee: Agency for Defense Development, Daejeon (KR)

( * ) Notice: Subject to any disclaimer, the term of this patent is extended or adjusted under 35 U.S.C. 154(b) by 0 days.

(21) Appl. No.: 13/833,417

(22) Filed: Mar. 15, 2013

(65) Prior Publication Data

US 2013/0249391 A1 Sep. 26, 2013

(30) Foreign Application Priority Data

Mar. 26, 2012 (KR) ..... 10-2012-0030428

(51) Int. Cl.
*H01J 17/04* (2012.01)
*H01J 61/04* (2006.01)

(52) U.S. Cl.
CPC ..... *H01J 17/04* (2013.01)
USPC ..... 313/631; 307/106; 307/107; 307/108

(58) Field of Classification Search
USPC ..... 313/631; 307/106–108
See application file for complete search history.

(56) References Cited

U.S. PATENT DOCUMENTS

| | | | | |
|---|---|---|---|---|
| 2,422,176 | A | 6/1947 | Benioff | |
| 3,659,203 | A | 4/1972 | Ross et al. | |
| 3,705,354 | A | 12/1972 | Oetzel | |
| 4,491,842 | A | 1/1985 | Gripshover et al. | |
| 6,822,394 | B2 | 11/2004 | Staines et al. | |
| 7,233,084 | B2 | 6/2007 | Dommer et al. | |
| 7,345,382 | B2 * | 3/2008 | Mayes et al. | 307/106 |
| 7,626,468 | B2 | 12/2009 | Staines | |
| 7,741,735 | B2 * | 6/2010 | Mayes et al. | 307/106 |

(Continued)

FOREIGN PATENT DOCUMENTS

KR 10-2010-0084901 A 7/2010

OTHER PUBLICATIONS

Stuart L. Moran, "High Repetition Rate LC Oscillator," IEEE Transactions on Electron Devices, vol. Ed-26, No. 10, Oct. 1979.

(Continued)

*Primary Examiner* — Thomas A Hollweg
(74) *Attorney, Agent, or Firm* — LRK Patent Law Firm

(57) ABSTRACT

A spark gap switch for high power ultra-wideband electromagnetic wave radiation is provided. The spark gap switch includes a casing, electrodes, brackets and an electrode protrusion. Openings are formed in respective opposite ends of the casing. The electrodes are installed in the casing at positions spaced apart from each other in such a way that the electrodes face each other and are disposed inside the openings. The brackets are installed in the respective openings of the casing. The brackets fasten rear ends of the corresponding electrodes to the casing. The electrode protrusion is provided on a central portion of at least either of the electrodes to induce stabilized discharge. The maximum diameter of the electrodes is smaller than the inner diameter of the casing so that the circumferential outer surfaces of the electrodes do not make contact with the circumferential inner surface of the casing.

15 Claims, 5 Drawing Sheets

(56) References Cited

U.S. PATENT DOCUMENTS

| | | | | |
|---|---|---|---|---|
| 7,741,783 | B2 | 6/2010 | Stark et al. | |
| 8,358,176 | B2 * | 1/2013 | Stark et al. | 331/127 |
| 2005/0285447 | A1 * | 12/2005 | Mayes et al. | 307/106 |
| 2006/0250744 | A1 * | 11/2006 | McTigue et al. | 361/120 |
| 2006/0290586 | A1 * | 12/2006 | Lee et al. | 343/801 |
| 2007/0296342 | A1 * | 12/2007 | Mayes | 315/111.01 |
| 2008/0238210 | A1 * | 10/2008 | Mayes et al. | 307/106 |
| 2010/0001644 | A1 * | 1/2010 | Stark et al. | 315/39 |
| 2011/0018778 | A1 | 1/2011 | Mayes et al. | |

OTHER PUBLICATIONS

L. F. Rinehart et al., "Development of UHF Spark-Switched L-C Oscillators," 9th IEEE International Pulsed Power Conference Tech. Dig., 1993.

Kevin D. Hong et al., "Resonant Antenna-Source System for Generation of High-Power Wideband Pulses," IEEE Transactions on Plasma Science, vol. 30, No. 5, Oct. 2002.

Partha Sarkar et al., "A Compact Battery-Powered Half-Megavolt Transformer System for EMP Generation," IEEE Transactions on Plasma Science, vol. 34, No. 5, Oct. 2006.

* cited by examiner

SPARK GAP SWITCH FOR HIGH POWER ULTRA-WIDEBAND ELECTROMAGNETIC WAVE RADIATION FOR STABILIZED DISCHARGE

CROSS REFERENCE TO RELATED APPLICATION

This application claims the benefit of Korean Patent Application No. 10-2012-0030428, filed on Mar. 2, 2012, which is hereby incorporated by reference in its entirety into this application.

BACKGROUND OF THE INVENTION

1. Field of the invention

The present invention relates generally to spark gap switches for high power ultra-wideband electromagnetic wave radiation for stabilized discharge and, more particularly, to a spark gap switch for high power ultra-wideband electromagnetic wave radiation which is configured such that it can have stabilized discharge characteristics that allow discharge to occur on central portions of electrodes, whereby the output power of radiated electromagnetic waves can be markedly stabilized.

2. Description of the Related Art

Generally, ultra-wideband electromagnetic wave generation sources refer to apparatuses which are widely used in fields, such as a field using ultra-wideband radar or a field involving the detection of buried objects. An ultra-wideband electromagnetic wave generation source typically includes an energy storage device which stores electric or magnetic energy, a switching device which generates ultra-wideband pulses from the stored energy, and an antenna which radiates ultra-wideband waves.

To increase the peak output power of electromagnetic waves radiated into space from such an ultra-wideband electromagnetic wave generation source, it is most important to increase the capacitance or inductance of the energy storage device, reduce mismatching between the switching device and the antenna, and enhance the electric insulation of the antenna.

The applicant of the present invention proposed a spark gap switch for high power ultra-wideband electromagnetic wave radiation in Korean Patent Registration No. 1015958, which can be used as a high power switching device and can conduct functions of storage of electric energy and generation and radiation of ultra-wideband electromagnetic pulses or waves.

FIGS. 1 and 2 illustrate the above-stated conventional spark gap switch for high power ultra-wideband electromagnetic wave radiation. As shown in FIGS. 1 and 2, the conventional spark gap switch for high power ultra-wideband electromagnetic wave radiation includes a casing 100, electrodes 111 and 112, a fixing bracket 120 and a movable bracket 121.

The casing 100 has a hollow cylindrical structure which has openings 101 and 102 in opposite ends thereof and is made of nonmetallic electric insulation material.

The electrodes 111 and 112 are disposed in the openings 101 and 102 of the casing 100 at positions spaced apart from each other by a predetermined distance in such a way that they face each other. The electrode 111 is a high-voltage electrode to which high voltage is supplied, and the other electrode 112 is a ground electrode which forms a potential difference with respect to the high-voltage electrode. The electrodes 111 and 112, when power is applied thereto, together conduct functions of storage of electric energy, generation of ultra-wideband electromagnetic, pulses and radiation of electromagnetic waves. Particularly, the spark gap switch is designed such that areas of surfaces of the electrodes 111 and 112 that face each other are comparatively large and the distance between the electrodes 111 and 112 is comparatively short, whereby the capacitance formed by the electrodes 111 and 112 can be enhanced. In other words, before functioning as a switch for generating electromagnetic pulses, the electrodes 111 and 112 are designed such that the capacitance at which an electric field is stored in the insulation space 115 defined between the electrodes 111 and 112 and the casing 100 is increased.

The fixing bracket 120 and the movable bracket 121 are made of electric insulation material in the same manner as that of the casing 100 and are installed in the electrodes 111 and 112. The fixing bracket 120 and the movable bracket 121 function to adjust the distance between the electrodes 111 and 112, fix the positions of the electrodes 111 and 112, and maintain gas pressure between the electrodes 111 and 112. The fixing bracket 120 is fixed in the opening 102 of the casing 100. The electrode 112 is fastened to the casing 100 by the fixing bracket 120. The movable bracket 121 has an external thread 122 and is threadedly coupled to the opening 101 of the casing 100 so that it can be movably installed in the opening 101 of the casing 100.

Cable guides 125 are provided in the fixing bracket 120 and the movable bracket 121. High-voltage cables through which high-voltage is supplied to the electrodes 111 and 112 are guided into the corresponding electrodes by the cable guides 125. An inner end of each cable guide 125 is supported on an inner surface of the corresponding electrode 111, 112. An annular plate 126 which is supported on the fixing bracket 120 or the movable bracket 321 is provided around an outer portion of each cable guide 125. The cable guides 125 are made of insulation material and function to protect high-voltage cables and prevent generation of an are from the high-voltage cables.

Gaskets 117 are closely interposed between a circumferential inner surface of the casing 100 and circumferential outer surfaces of the respective electrodes 11 and 112 to seal space defined between the casing 100 and the electrodes 111 and 112.

The conventional spark gap switch having the above-mentioned construction can be used as an ultra-wideband electromagnetic wave generation source which is widely used as a high power switching device and conducts functions of storage of electric energy and generation and radiation of ultra-wideband electromagnetic pulses. Furthermore, the electrodes 111 and 112 are configured such that the areas of the surfaces that face each other are comparatively large to increase the capacitance between the electrodes 111 and 112, the distance therebetween is adjusted, and the space therebetween is insulated by high-pressure gas. Therefore, switch storage energy which is an energy source for the generation of electromagnetic waves is comparatively high. Moreover, the shape of each electrode 111, 112 is designed such that it can become an antenna. Thus, mismatching between a switching channel and an antenna is reduced. The electrodes 111 and 112 which form an antenna are enclosed by high-pressure gas with which the spark gap switch is filled. Hence, the electric insulation strength of the electrodes 111 and 112 is enhanced, and the intensity of ultra-wideband electromagnetic waves radiated between the electrodes 111 and 112 is increased.

However, in the conventional spark gap switch for high power ultra-wideband electromagnetic wave radiation, because the surfaces of the electrodes 111 and 112 that face each other are comparatively large and are gently curved to increase the capacitance of the electrodes, although it is ideal that discharge occurs on central portions of the electrodes at which the distance between the electrodes is shortest, there is actually the possibility of discharge occurring at a random position of the surfaces of the two electrodes that face each other.

Furthermore, the conventional spark gap switch is designed such that the maximum diameter of the electrodes is almost the same as the inner diameter of the casing 100. Thus, the spark gap switch is prone to discharge occurring on the inner surface of the casing 100. That is, as shown in FIG. 1, because outer surfaces of rear ends of the electrodes 111 and 112 which face each other make contact with an inner surface of the casing 100, a surface insulation distance d1 formed along the inner surface of the casing 100 may not be sufficiently long.

Therefore, a surface discharge may be caused on the inner surface of the casing 100. As such, if discharge occurs at a position displaced from the central portions of the electrodes 111 and 112, the output power of electromagnetic waves is reduced, and a radiation pattern is deformed, in this case, the spark gap switch cannot serve its intended purpose.

SUMMARY OF THE INVENTION

Accordingly, the present invention has been made keeping in mind the above problems occurring in the prior art, and an object of the present invention is to provide a spark gap switch for high power ultra-wideband electromagnetic wave radiation which is configured such that it can have stabilized discharge characteristics that allow discharge to occur on central portions of electrodes, whereby the output power of radiated electromagnetic waves can be markedly stabilized.

In order to accomplish the above object the present invention provides a spark gap switch for high power ultra-wideband electromagnetic radiation, including: a casing having a cylindrical shape, with openings formed in respective opposite ends of the casing; a plurality of electrodes installed in the casing at positions spaced apart from each other by a predetermined distance in such a way that the electrodes face each other and are disposed inside the openings, wherein surfaces of the electrodes that face each other comprise planar or curved surfaces to increase capacitance: a plurality of brackets installed in the respective openings of the casing, the brackets fastening rear ends of the corresponding electrodes to the casing; and an electrode protrusion provided on a central portion of at least either of the electrodes, the electrode protrusion inducing stabilized discharge.

Each of the electrodes may have a "U" shape.

An electrode assisting member may be provided on a central portion of at least either of the electrodes and a peripheral portion of the central portion and be made of different material from the electrodes.

The electrode protrusion may be disposed on a central portion of the electrode assisting member and be made of material equal to the material of the electrode assisting member.

The electrode assisting member and the electrode protrusion may be provided on each of the electrodes, wherein a diameter of the electrode assisting member provided on a central portion of either of the electrodes may be greater than a diameter of the electrode assisting member provided on a central portion of a remaining one of the electrodes.

The electrode assisting members and the electrode protrusions may be made of any one selected from the group consisting of tungsten, copper-tungsten and molybdenum.

A diameter of each of the electrode protrusions may range from 1% to 10% of a maximum diameter of the electrodes, and a thickness of the electrode protrusion may range from 0.2% to 2% of the maximum diameter of the electrodes.

The diameter of the electrode protrusion may be 5% of the maximum diameter of the electrodes, and the thickness of the electrode protrusion may be 0.5% of the maximum diameter of the electrodes.

An edge of the electrode protrusion may have a rounded ring shape.

Each of the brackets may include: a disk-shaped bracket body having an outer diameter corresponding to an inner diameter of the casing; and an insert support part horizontally protruding from one side of the bracket body and having an outer diameter that is less than the outer diameter of the bracket body and corresponds to an inner diameter of the corresponding electrode, the insert support part being inserted into and fixed in the electrode, wherein an annular stepped portion may be formed between the bracket body and the insert support part so that the rear end of the corresponding electrode is supported on the annular stepped portion.

External threads may be respectively formed on circumferential outer surfaces of the bracket body and the insert support parts of the brackets, first internal threads may be respectively formed in circumferential inner surfaces of die opposite ends of the casing, the first internal threads corresponding to the respective external threads of the bracket bodies, and second internal threads may be respectively formed on circumferential inner surfaces of the rear ends of the electrodes, the second internal threads corresponding to the external threads of fee respective insert support parts, whereby the brackets are threaded coupled to the openings of the casing and the electrodes in such a way that the brackets are movably installed in the corresponding openings of the casing so that relative positions of the electrodes are adjusted in the casing.

Cable holes may be respectively formed in the brackets so that high-voltage cables for supplying high-voltage to the electrodes are led into the casing through the cables holes.

A maximum diameter of each of the electrodes may be less than an inner diameter of the casing so that entire circumferential outer surfaces of the electrodes supported by the respective brackets are not brought into contact with a circumferential inner surface of the casing, whereby a distance for surface insulation in the casing is increased, thus preventing a surface discharge being caused on the inner surface of the casing.

An insulation space may be enclosed between the electrodes and the casing and be filled with a high-voltage insulation material, and gaskets may be respectively closely interposed between outer surfaces of the rear ends of the brackets and an inner surface of the casing and between inner surfaces of the electrodes and outer surfaces of front ends of the brackets so that the high-voltage Insulation material is prevented from leaking out of the insulation space.

In the present invention, at least one of two electrodes has on a central portion thereof an electrode assisting member which is made of different material from the electrode. An electrode protrusion for guiding stabilized discharge is provided on a central portion of the electrode assisting member. Thereby, stabilized discharge characteristics between the two electrodes are ensured. Furthermore, the surface insulation distance formed along the inner surface of the casing is longer than that of the conventional technique so that a surface discharge phenomenon in which discharge is caused on the inner surface of the casing can be prevented. Thereby, the output of electromagnetic waves radiated from the spark gap switch for high power ultra-wideband electromagnetic wave radiation can be markedly stabilized even when it is repeatedly used.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
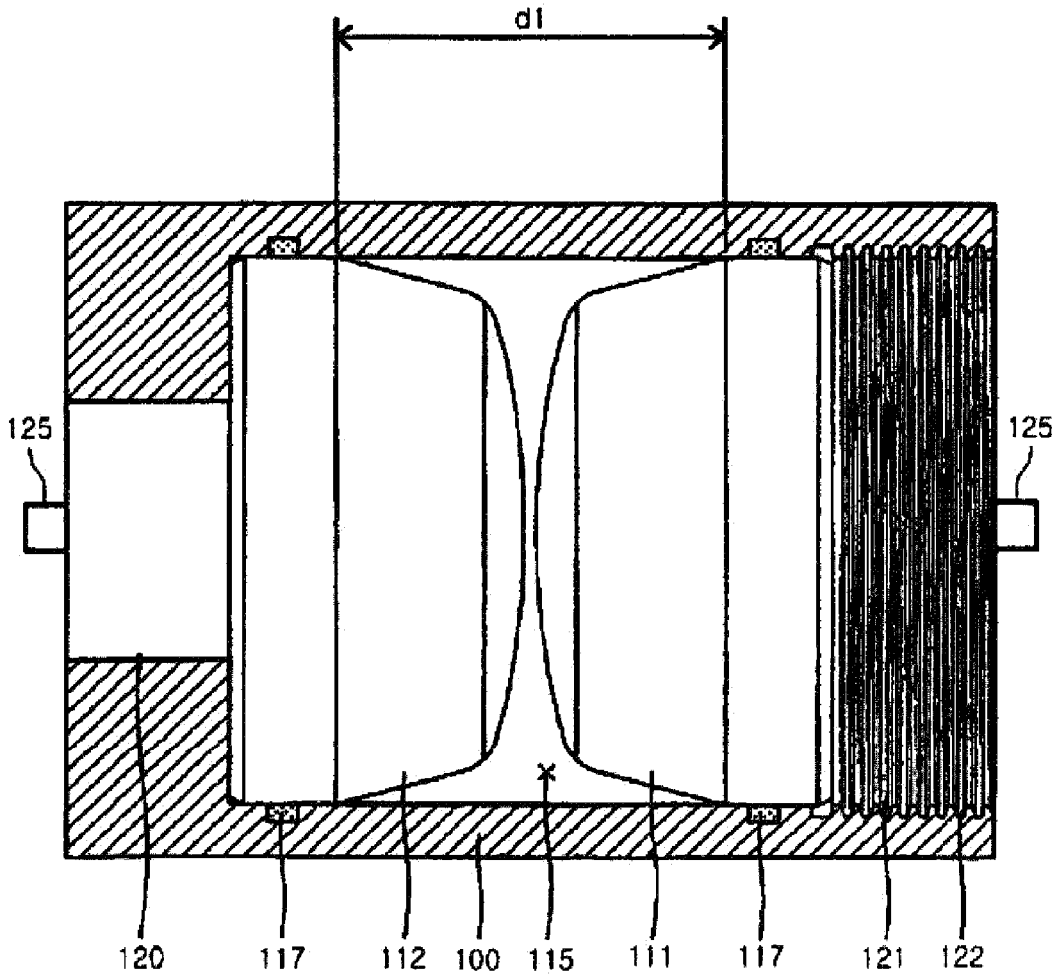
RELATED ART FIG. 1
FIG. 1 is a front sectional view of a casing of a spark gap switch for high power ultra-wideband electromagnetic radiation, according to a conventional technique.
Figure 2:
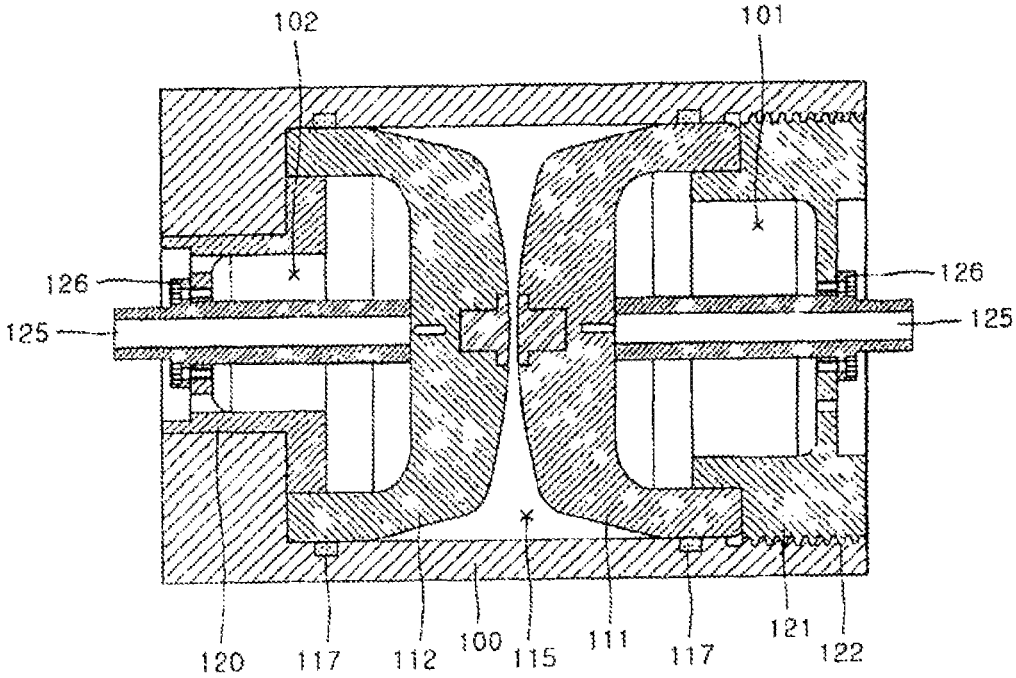
RELATED ART FIG. 2
FIG. 2 is a longitudinal sectional view of FIG. 1.

Reference now should be made to the drawings, throughout which the same reference numerals are used to designate the same or similar components.

Hereinafter, the present invention will be described in detail with reference to the attached drawings.

Figure 3:
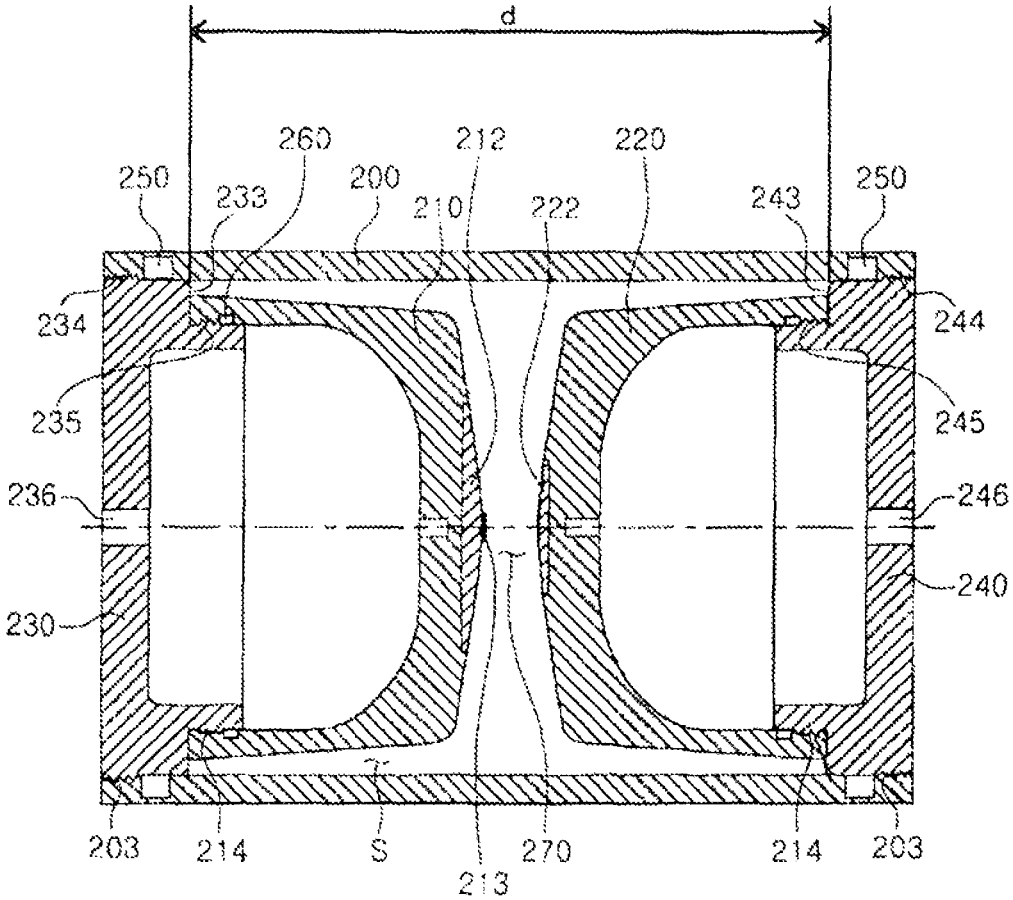
FIG. 3 is a longitudinal sectional view of a spark gap switch for high power ultra-wideband electromagnetic radiation which has stabilized discharge characteristics, according to an embodiment of the present invention.
Figure 4:
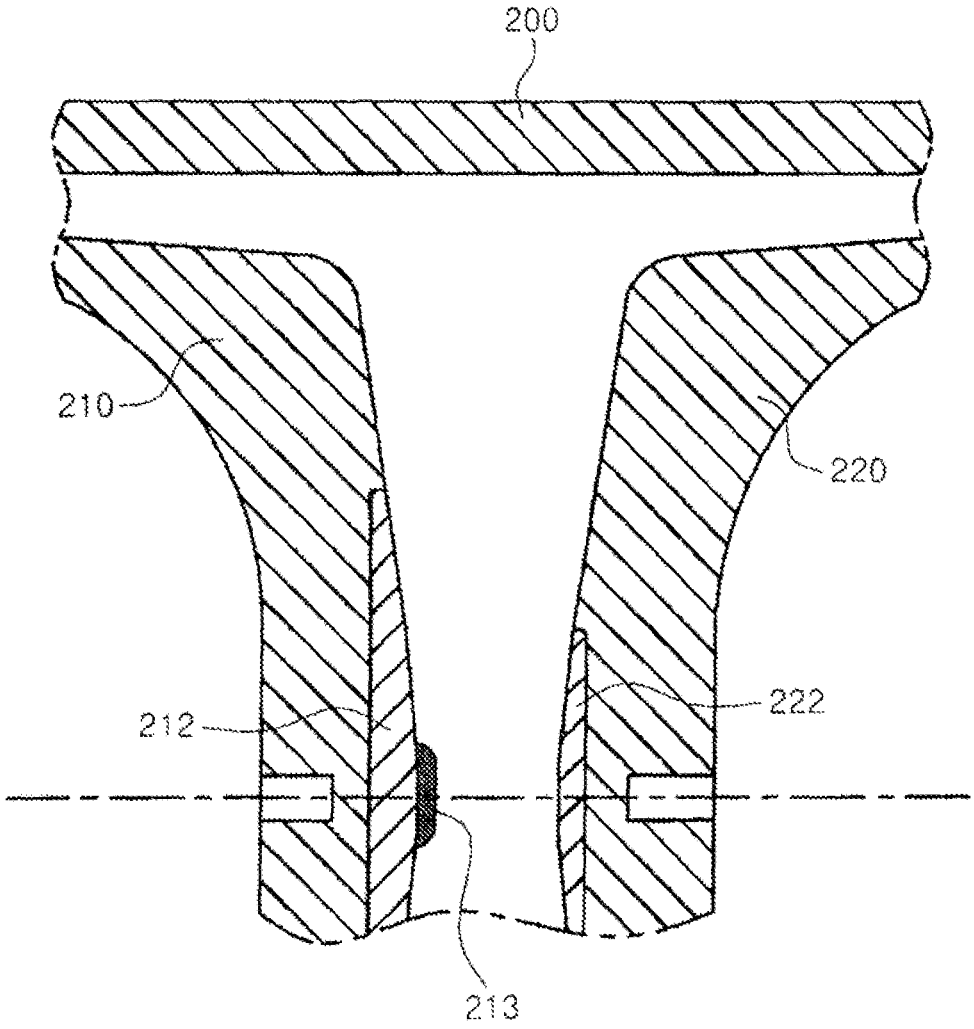
FIG. 4 is an enlarged view of a central portion of an electrode of FIG. 3.
Figure 5:
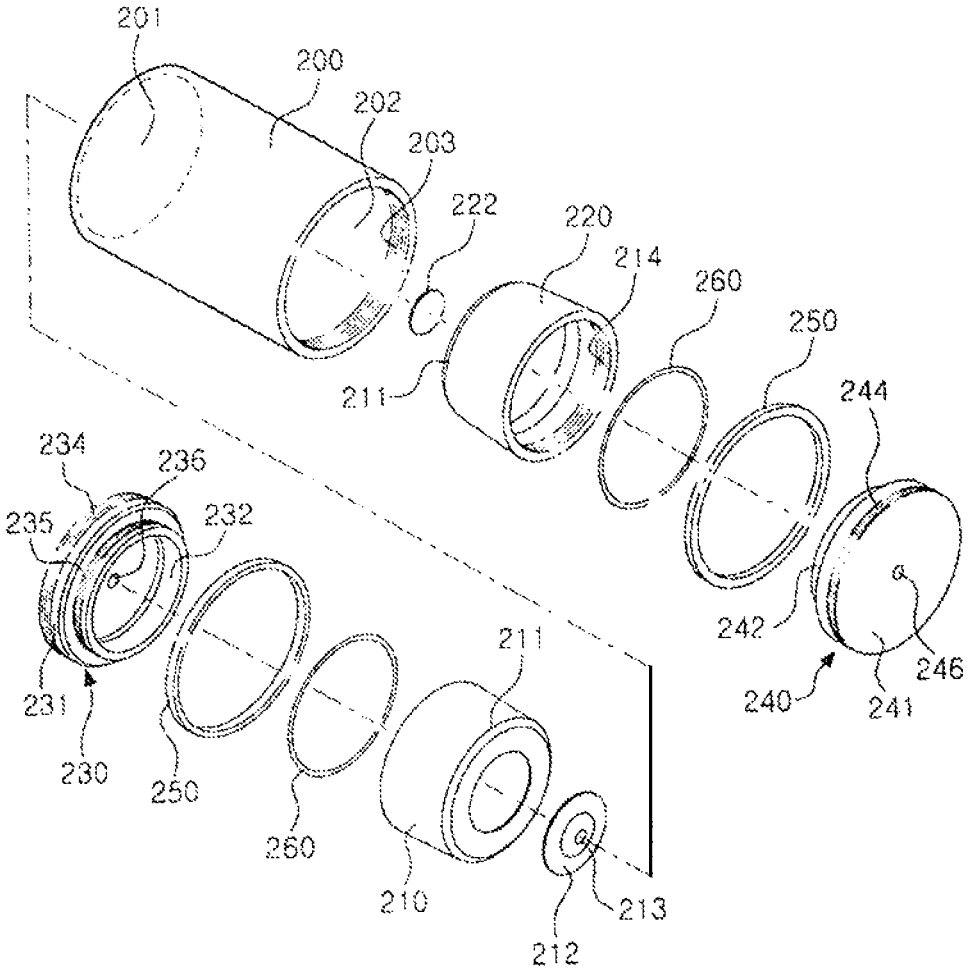
FIG. 5 is an exploded perspective view of the spark gap switch of FIG. 3.

FIG. 3 is a longitudinal sectional view of a spark gap switch for high power ultra-wideband electromagnetic radiation which has a stabilized discharge characteristics, according to an embodiment of the present invention. FIG. 4 is an enlarged view of a central portion of an electrode of FIG. 3. FIG. 5 is an exploded perspective view of the spark gap switch according to the embodiment of the present Invention.

As shown in the drawings, the spark gap switch according to the embodiment of the present invention includes a casing 200, a pair of electrodes 210 and 220 and a pair of brackets 230 and 240.

The casing 200 is an insulation housing which encloses insulation material in an insulation space S defined between the electrodes 210 and 220 which will be explained later. The casing 200 has a cylindrical structure which has openings 201 and 202 on respective opposite side ends thereof and has a hollow space therein.

The electrode 210 is a high-voltage electrode to which high voltage is supplied. The electrode 220 is an electrode which forms a potential difference with respect to the high-voltage electrode 210. The electrodes 210 and 220 are disposed inside the openings 201 and 202 at positions spaced apart from each other in such a way that they lace each other. The electrodes 210 and 220, when power is applied thereto, together conduct functions of storage of electric energy, generation of ultra-wideband electromagnetic pulses and radiation of electromagnetic waves.

Furthermore, the electrodes 210 and 220 have the same approximate U shape, wherein portions of the electrodes 210 and 220 that face each other have planar or curved surfaces, each of which has a predetermined area, so that the areas of the surfaces of the electrodes 210 and 220 that face each other are comparatively large, and a distance between the electrodes 210 and 220 can be reduced. Thanks to this design of the electrodes 210 and 220, capacitance which is formed by the facing surfaces of the electrodes 210 and 220 can be increased. In addition, each electrode 210, 220 has an annular line 211 which is formed along a circumferential outer surface and forms a boundary at which discontinuous surfaces are bent, such that the electrode 210, 220 can function as an antenna when, upon voltage higher than a preset voltage for the electrodes 210 and 220 being supplied thereto, discharge is caused on the electrode protrusion 213 and high power electromagnetic waves are generated.

Particularly, the electrodes 210 and 220 have the electrode protrusion 213 which is provided on the center of their portions facing each other to guide stabilized discharge. In FIG. 3, although the electrode protrusion 213 has been illustrated as being provided on either electrode 210 or 220, e.g., on the electrode 210, it is not limited to this structure. For example, both the two electrodes 210 and 220 may have electrode protrusions 213. The most important factors for ensuring stabilized discharge on the central portions of the electrodes 210 and 220 are a diameter and a height of the electrode protrusion 213.

A diameter of the electrode protrusion 213 must be less than that of the electrode 210 or 220. If the diameter of the electrode protrusion 213 is larger than the maximum diameter of the electrode 210 or 220, discharge occurs at several portions of the electrode protrusion 213, and a discharge portion which has a comparatively large deviation may be a factor which makes the output power of radiated electromagnetic waves to be unstable. If the diameter of the electrode protrusion 213 is very small compared to the maximum diameter of the electrode 210 or 220, the shape of the electrode protrusion 213 may be excessively sharp so that a high electric field is formed on the electrode protrusion 213. In this case, discharge is incurred at comparatively low voltage, thus causing a reduction in the output power of electromagnetic waves. Therefore, it is preferable that the diameter of the electrode protrusion 213 ranges from 1% to 10% of the maximum diameter of the electrode 210 or 220. More preferably, the diameter of the electrode protrusion 213 is 5% of the maximum diameter of the electrode 210 or 220.

Furthermore, preferably, a thickness of the electrode protrusion 213 ranges from 0.2% to 2% of the maximum diameter of the electrode 210 or 220. If the thickness of the electrode protrusion 213 is smaller than 0.2% of the maximum diameter of the electrode 210 or 220, there is little effect of protrusion. If the thickness of the electrode protrusion 213 is larger than 2% of the maximum diameter of the electrode 210 or 220, the distance between the electrodes 210 and 220 is increased and the capacitance between the electrodes 210 and 220 is decreased, thus reducing the output power of electromagnetic waves. More preferably, the thickness of the electrode protrusion 213 is 0.5% of the maximum diameter of the electrode 210 or 220.

An edge of the electrode protrusion 213 has a rounded ring shape. If the electrode protrusion 213 is formed under the above-mentioned conditions, the electrodes 210 and 220 cars have comparatively high discharge start voltage despite the capacitance of the electrodes 210 and 220 being not largely reduced. Particularly, discharge can be concentrated on the central portion of the electrodes 210 and 220 and be stabilized.

Meanwhile, if the discharge of the electrodes 210 and 220 occurs repetitively, erosion of the discharge portion may deform the shape thereof tints reducing the dielectric strength. To avoid this problem, in the present invention, electrode assisting members 212 and 222 are respectively provided on the electrodes 210 and 220 both at the central portion on which the electrode protrusion 213 is disposed and at a periphery of the central portion. Each of the electrode assisting member 212, 222 is made of any one of tungsten, copper-tungsten and molybdenum, which have superior discharge durability.

The reason why only the electrode protrusion 213 and the peripheral portion of the electrode protrusion 213 are made of different material having high durability to the discharge is due to the fact that if the entirety of the electrode 210, 220 is made of tungsten, copper-tungsten or molybdenum, not only does it become very heavy and expensive, but it also becomes difficult to machine the electrode 210, 220. For these reasons, the electrode body which is comparatively large is made of light metal such as aluminum, and only the portion around which the discharge is generated is made of different material which has high durability to the discharge.

Here, in the case where the electrode assisting members 212 and 222 are respectively provided on the opposite electrodes 210 and 220, if the diameters of the electrode assisting members 212 and 222 are the same, the circumferential edges of the electrode assisting members 212 and 222 face each other. In this case, there is a high possibility of discharge occurring on the circumferential edges of the electrode assisting members 212 and 222. This is due to that fact that portions which are prone to electric discharge are formed along the circumferential edges of the electrode assisting members 212 and 222 by a manufacturing error, a thermal expansion coefficient difference, bonding between different materials, etc., and these portions that are prone to electric discharge face each other with the least distance therebetween. To avoid such a problem of the use of the electrode assisting members 212 and 222, in the present invention, as shown in FIG. 4, the diameter of either electrode assisting member (for example, the electrode assisting member 212 of FIG. 4) is greater than that of the other electrode assisting member (for example, electrode assisting member 222 of FIG. 4) so that the circumferential edges of the two electrode assisting members 212 and 222 do not face each other.

The brackets 230 and 240 are respectively movably installed in the openings 201 and 202 of the casing 200 so that the two electrodes 210 and 220 can be fixed in positions after the relative positions of the electrodes 210 and 220 in the casing 200 are adjusted. Bach bracket 230, 240 includes a disk-shaped bracket body 231, 241 which has an outer diameter corresponding to an inner diameter of the casing 200, and an insert support part 232, 242 which axially protrudes as shown in FIG. 5, from one side of the bracket body 231, 241 and has an outer diameter that is less than the outer diameter of the bracket body 231, 241. The insert support part 232, 242 corresponds to an inner diameter of the corresponding electrode 210, 220. The insert support part 232, 242 is inserted into and fixed in the corresponding electrode 210, 220. An annular stepped portion 233, 234 is formed between the bracket body 231, 241 and the insert support part 232, 242 so that the rear end of the corresponding electrode 210, 220 is supported on the annular stepped portion 233, 234. External threads 234, 235, 244 and 245 are respectively formed on circumferential outer surfaces of the bracket bodies 231 and 241 and the insert support parts 232 and 242. Internal threads 203 which respectively correspond to the external threads 234 and 244 of the bracket bodies 231 and 241 are formed in the circumferential inner surfaces of the opposite ends of the casing 200. Internal threads 214 are respectively formed on the circumferential inner surfaces of the rear ends (that is, the ends opposite to the electrode protrusion 213) of the electrodes 210 and 220. The internal threads 214 of the electrodes 210 and 220 respectively correspond to the external threads 235 and 245 of the insert support parts 232 and 242. Here, the external thread 234, 244 is formed on only a portion of the circumferential outer surface of the bracket body 231, 241 rather than on the entirety of the circumferential outer surface thereof. Thanks to the above-stated structure, as shown in FIG. 3, the brackets 230 and 240 facilitate the coupling of the electrodes 210 and 220 to the casing 200 in such a way that the brackets 230 and 240 are threadedly coupled to the openings 201 and 202 of the casing 200 and the electrodes 210 and 220. In this embodiment, although the two brackets 230 and 240 have been illustrated as being movably installed in the casing 200 so that the rear ends of the electrodes 210 and 220 are fixed in place after the relative positions of the two electrodes 210 and 220 are adjusted, the present invention is not limited to this. For example, the optimum positions of the electrodes 210 and 220 are determined in a design stage, and the electrodes 210 and 220 may be directly fixed to the brackets 230 and 240 at the optimum positions.

Meanwhile, in the present invention, to markedly reduce the possibility of discharge to an inner surface of the casing 200, as shown in FIG. 3, the insulation space S is formed between the two electrodes 210 and 220 and between the casing 200 and the two electrodes 210 and 220. The insulation space S for preventing surface discharge from being caused on the inner surface of the casing 200 is formed between the two electrodes 210 and 220 and the casing 200 by making the largest outer diameters of the electrodes 210 and 220 to be less than the inner diameter of the casing 200. The outer surfaces of the rear ends of the electrodes 210 and 220 which are fixed in place by the casing 200 and the brackets 230 and 240 are spaced apart from the inner surface of the casing 200 by the insulation space S. Therefore, a distance d which corresponds an inner surface electrical insulation distance of the casing 200 which corresponds to an inner surface electrical insulation distance of the casing 200 is longer than the distance d1 of FIG. 1. As a result, the present invention can markedly reduce the possibility of a surface discharge phenomenon in which discharge occurs on the inner surface of the casing 200.

The insulation space S enclosed by the electrodes 210 and 220 and the casing 200 is filled with high-voltage insulation material 270 which is liquid or gas. To prevent the high-voltage insulation material 270 from leaking out of the casing 200, as shown in FIG. 3 a gasket 250 is closely interposed between the outer surface of the rear end of each bracket 230, 240 and the inner surface of the casing 200. In the conventional invention, as shown in FIG. 1, the gasket 117 is disposed between each electrode 111, 112 and the casing 100. However, in the present invention, because the gasket 250 is disposed between each bracket 230, 240 and the casing 200, the present invention can have stabilized high-voltage dielectric strength compared to that of FIG. 1. In the same manner, a gasket 260 having the same function as that of the above-mentioned gasket 250 is closely interposed between the inner surface of each electrode 210, 220 and the outer surface of a front end of the corresponding bracket 230, 240, that is, the insert support part 232, 242.

Cable holes 236 and 246 are respectively formed in the brackets 230 and 240 so that high-voltage cables for supplying high-voltage to the electrodes 210 and 220 are led into the casing 200 through the cables holes 236 and 246.

As described above, a spark gap switch for high power ultra-wideband electromagnetic radiation according to the present invention can be a high power ultra-wideband electromagnetic generation source. That is, the spark gap switch, even though which is composed of only one device, can conduct several functions together such as a capacitor to store electric energy, a switch to form ultra-wideband electromagnetic pulses and an antenna to radiate electromagnetic waves.

Particularly, the spark gap switch of the present invention has stabilized discharge characteristics on a central portion thereof so that when it is operated not only in a sing shot mode but also in a repetition mode, the output of electromagnetic waves radiated from the spark gap switch can be markedly stabilized.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Therefore, the bounds of the present invention must be defined by the claims, and all of technical spirits within the equivalent range must also be regarded as falling within the bounds of the present invention.

What is claimed is:

1. A spark gap switch for high power ultra-wideband electromagnetic wave radiation, comprising:

a casing having a cylindrical shape, with openings formed in respective opposite ends of the casing;

a plurality of electrodes installed in the casing at positions spaced apart from each other by a predetermined distance in such a way that the electrodes face each other and are disposed inside the openings, wherein surfaces of the electrodes that face each other comprise planar or curved surfaces;

a plurality of brackets installed in the respective openings of the casing, the brackets fastening rear ends of the corresponding electrodes to the casing; and an electrode protrusion provided on a central portion of at least either of the electrodes, the electrode protrusion inducing stabilized discharge, wherein each of the electrodes has a "U" shape, wherein an electrode assisting member is provided on a central portion of at least either of the electrodes and a peripheral portion of the central portion and is made of different material from the electrodes, and wherein the electrode protrusion is disposed on a central portion of the electrode assisting member and is made of material equal to the material of the electrode assisting member.

2. The spark gap switch as set forth in claim 1, wherein the electrode assisting member and the electrode protrusion are provided on each of the electrodes, wherein a diameter of the electrode assisting member provided on a central portion of either of the electrodes is greater than a diameter of the electrode assisting member provided on a central portion of a remaining one of the electrodes.

3. The spark gap switch as set forth in claim 2, wherein the electrode assisting members and the electrode protrusions are made of any one selected from the group consisting of tungsten, copper-tungsten and molybdenum.

4. The spark gap switch as, set forth in claim 3, wherein a diameter of each of the electrode protrusions ranges from 1% to 10% of a maximum diameter of the electrodes, and a thickness of the electrode protrusion ranges from 0.2% to 2% of the maximum diameter of the electrodes.

5. The spark gap switch as set forth in claim 4, wherein the diameter of the electrode protrusion is 5% of the maximum diameter of the electrodes, and the thickness of the electrode protrusion is 0.5% of the maximum diameter of the electrodes.

6. The spark gap switch as set forth in claim 5, wherein an edge of the electrode protrusion has a rounded ring shape.

7. The spark gap switch as set forth in claim 4, wherein an edge of the electrode protrusion has a rounded ring shape.

8. The spark gap switch as set forth in claim 3, wherein an edge of the electrode protrusion has a rounded ring shape.

9. The spark gap switch as set forth in claim 2, wherein an edge of the electrode protrusion has a rounded ring shape.

10. The spark gap switch as set forth in claim 1, wherein an edge of the electrode protrusion has a rounded ring shape.

11. The spark gap switch as set forth in claim 1, wherein each of the brackets comprises:

a disk-shaped bracket body having an outer diameter corresponding to an inner diameter of the casing; and an insert support part axially protruding from one side of the bracket body and having an outer diameter that is less than the outer diameter of the bracket body and corresponds to an inner diameter of the corresponding electrode, the insert support part being inserted into and fixed in the electrode, wherein an annular stepped portion is formed between the bracket body and the insert support part so that the rear end of the corresponding electrode is supported on the annular stepped portion.

12. The spark gap switch as set forth in claim 11, wherein external threads are respectively formed on circumferential outer surfaces of the bracket body and the insert support parts of the brackets, first internal threads are respectively formed in circumferential inner surfaces of the opposite ends of the casing, the first internal threads corresponding to the respective external threads of the bracket bodies, and second internal threads are respectively formed on circumferential inner surfaces of the rear ends of the electrodes, the second internal threads corresponding to the external threads of the respective insert support parts, whereby the brackets are threadedly coupled to the openings of the casing and the electrodes in such a way that the brackets are movably installed in the corresponding openings of the casing so that relative positions of the electrodes are adjusted in the casing.

13. The spark gap switch as set forth in claim 12, wherein cable holes are respectively formed in the brackets so that high-voltage cables for supplying high-voltage to the electrodes are led into the casing through the cables holes.

14. The spark gap switch as set forth in claim 1, wherein a maximum diameter of each of the electrodes is less than an inner diameter of the casing so that entire circumferential outer surfaces of the electrodes supported by the respective brackets are not brought into contact with a circumferential inner surface of the casing, whereby a surface insulation distance formed along the inner surface of the casing is increased, thus preventing a surface discharge being caused on the circumferential inner surface of the casing.

15. The spark gap switch as set forth in claim 1, wherein an insulation space is formed between the electrodes and the casing and is filled with a high-voltage insulation material, and gaskets are respectively closely interposed between outer surfaces of the rear ends of the brackets and an inner surface of the casing and between inner surfaces of the electrodes and outer surfaces of front ends of the brackets so that the high-voltage insulation material is prevented from leaking out of the insulation space.

* * * * *